US007576048B2

(12) United States Patent
Gray et al.

(10) Patent No.: US 7,576,048 B2
(45) Date of Patent: Aug. 18, 2009

(54) LIQUID LAUNDRY DETERGENTS CONTAINING CATIONIC HYDROXYETHYL CELLULOSE POLYMER

(75) Inventors: Peter Gerard Gray, Brussels (BE); Karel Jozef Maria Depoot, Anzegem-Vichte (BE); Luc Marie Willy Lievens, Erpe-Mere (BE); Falke Elisabeth Vanneste, Strombeek-Bever (BE); Serge Omer Alfons Jean Thooft, Herzele (BE)

(73) Assignee: The Procter & Gamble Company, Cincinnati, OH (US)

( * ) Notice: Subject to any disclaimer, the term of this patent is extended or adjusted under 35 U.S.C. 154(b) by 139 days.

(21) Appl. No.: 11/732,776

(22) Filed: Apr. 4, 2007

(65) Prior Publication Data

US 2008/0248986 A1 Oct. 9, 2008

(51) Int. Cl.

| | |
|---|---|
| ***C11D 3/22*** | (2006.01) |
| ***C11D 1/02*** | (2006.01) |
| ***C11D 1/66*** | (2006.01) |
| ***C11D 1/83*** | (2006.01) |
| ***C11D 3/37*** | (2006.01) |

(52) U.S. Cl. ..... 510/473; 510/276; 510/330; 510/331; 510/340; 510/357; 510/426; 510/437; 510/471; 510/475; 510/481; 8/137

(58) Field of Classification Search ..... 510/276, 510/330, 331, 340, 357, 426, 437, 471, 473, 510/475, 481; 8/137

See application file for complete search history.

(56) References Cited

FOREIGN PATENT DOCUMENTS

| | | | |
|---|---|---|---|
| EP | WO 2004/022686 | * | 3/2004 |
| WO | WO 93/05137 | | 3/1993 |
| WO | WO 01/46513 A1 | | 6/2001 |
| WO | WO 2004/022686 A1 | | 3/2004 |
| WO | WO 2004/113484 A1 | | 12/2004 |
| WO | WO 2006/063092 A1 | | 6/2006 |

OTHER PUBLICATIONS

International Search Report, mailed Sep. 18, 2007, 4 pages.

* cited by examiner

*Primary Examiner*—Brian P Mruk
(74) *Attorney, Agent, or Firm*—Armina E. Matthews; Kim William Zerby

(57) ABSTRACT

Aqueous liquid laundry detergent compositions useful for cleaning fabrics wherein the compositions contain from about 0.05% to about 0.4%, by weight of the composition, of a cationic hydroxyethyl cellulose polymer having a degree of substitution of the cationic charge of from about 0.01 to about 0.20; from about 5% to about 30%, by weight of the composition, of a surfactant comprising at least one anionic surfactant and at least one nonionic surfactant; and from about 2% to about 15%, by weight of the composition, of fatty acid. Use of such aqueous liquid laundry detergent compositions for handwashing delicate fabrics. Use of such aqueous liquid laundry detergent compositions for machine washing of delicate fabrics, wherein the machine washing occurs at a delicate machine setting.

18 Claims, No Drawings

LIQUID LAUNDRY DETERGENTS CONTAINING CATIONIC HYDROXYETHYL CELLULOSE POLYMER

FIELD OF THE INVENTION

The present invention relates to the use of cationic hydroxyethyl celluloses in liquid laundry detergent compositions for the laundering of textiles (e.g. clothing, linens, fabric).

BACKGROUND OF THE INVENTION

A large number of liquid laundry detergents are available to today's consumers. While many of the detergents adequately remove dirt, soil and odors, effectively cleaning textiles (for example, clothing items) very well in traditional horizontal axis and/or vertical access washing machines, there is an ongoing desire to provide consumers with additional fabric care benefits resulting from their laundry detergent and through the wash cycle, such as softening, color protection, protection from fabric wear, and gentle treatment of fine textiles (such as wool and silk).

Cationic polymers such as cationic hydroxyethyl cellulose polymers are traditionally commercially supplied for inclusion in detergent compositions, particularly hair products such as shampoos. More recently, such cationic polymers have been experimented with in heavy duty liquid laundry detergents to enhance deposition of other known materials that provide softening benefits to laundered textiles but do not deposit well during traditional washing machine cycles.

It has now been surprisingly discovered that such cationic polymers may in combination with surfactant and fatty acid provide fabric care benefits to laundered textiles, when included in selected aqueous liquid laundry detergent compositions.

SUMMARY OF THE INVENTION

The present invention relates to aqueous liquid laundry detergent compositions useful for cleaning delicate fabrics comprising from about 0.05% to about 0.4%, by weight of the composition, of a cationic hydroxyethyl cellulose polymer having a degree of substitution of the cationic charge of from about 0.01 to about 0.20; from about 5% to about 30%, by weight of the composition, of a surfactant comprising at least one anionic surfactant and at least one nonionic surfactant; and from about 2% to about 15%, by weight of the composition, of fatty acid.

The present invention further relates to aqueous liquid laundry detergent compositions useful for cleaning delicate fabrics, comprising from about 0.15% to about 0.2%, by weight of the composition, of a cationic hydroxyethyl cellulose polymer having a molecular weight of from about 200,000 to about 800,000 and a degree of substitution of the cationic charge of from about 0.01 to 0.20; from about 7% to about 15%, by weight of the composition, of a surfactant comprising an alkyl ethoxylate sulfate surfactant and at least one nonionic surfactant; from about 2% to about 10%, by weight of the composition, of fatty acid; wherein the composition is substantially free of optical brightener; and wherein the composition is substantially free of enzymes having cellulytic activity.

The present invention also relates to the above compositions wherein the cationic hydroxyethyl cellulose polymer has a degree of substitution of the cationic charge of from about 0.01 to about 0.1.

The present invention also relates to the above compositions wherein the cationic hydroxyethyl cellulose polymer has a degree of substitution of the cationic charge of from about 0.01 to less than 0.1.

The present invention also relates to the above compositions wherein the cationic hydroxyethyl cellulose polymer has a molecular weight of from about 200,000 to about 800,000.

The present invention also relates to the above compositions wherein the composition is substantially free of enzymes having cellulytic activity.

The present invention also relates to the above compositions wherein the composition is substantially free of optical brightener.

The present invention also relates to the above compositions wherein the composition comprises from about 0.1% to about 0.3%, by weight of the composition, of the cationic hydroxyethyl cellulose polymer.

The present invention also relates to the above compositions wherein the composition comprises from about 0.15% to about 0.2%, by weight of the composition, of the cationic hydroxyethyl cellulose polymer.

The present invention also relates to the above compositions wherein the composition comprises from about 7% to about 15%, by weight of the composition, of the surfactant.

The present invention also relates to the above compositions wherein the composition comprises from about 2.5% to about 7%, by weight of the composition, of the fatty acid.

The present invention also relates to the above compositions wherein the composition further comprises an opacifying agent.

The present invention also relates to the above compositions wherein the anionic surfactant is selected from alkyl ethoxylate sulfates and linear alkyl benzene sulfonates.

The present invention also relates to the above compositions wherein the anionic surfactant is selected from alkyl ethoxylate sulfates having a chain length of from about 12 to about 14 and a degree of ethoxylation of from about 1 to about 8.

The present invention also relates to the above compositions wherein the composition further comprises a suds suppressor.

The present invention also relates to the above compositions wherein the composition is substantially free of enzymes.

The present invention also relates to the above compositions wherein the composition further comprises a laundry adjunct ingredient selected from soil release polymers, dye transfer inhibiting polymers, chelants, performance boosting polymers, preservatives, stabilizers, structurants, viscosity modifiers, and citric acid.

The present invention also relates to the above compositions wherein the composition further comprises from about 0.01 to about 1% of a structurant that is selected from hydrogenated castor oil.

The present invention further relates to use of the above compositions for handwashing delicate fabrics.

The present invention further relates to use of the above compositions for machine washing of delicate fabrics, wherein the machine washing occurs at a delicate machine setting.

DETAILED DESCRIPTION OF THE INVENTION

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

All percentages, ratios and proportions herein are on a weight basis unless otherwise indicated.

The present invention relates to aqueous liquid laundry detergent compositions comprising a surfactant containing at least an anionic and an nonionic surfactant, fatty acid, and a cationic hydroxyethyl cellulose polymer having a degree of substitution of the cationic charge of from about 0.01 to about 0.20 and a molecular weight of from about 200,000 to about 800,000.

Without being limited by theory, it is now believed that the lower charge density of the cationic hydroxyethyl cellulose polymer is important in providing a liquid laundry detergent product containing relatively low levels of surfactant (at least an anionic surfactant and a nonionic surfactant) that is capable of offering both fabric care benefits and good cleaning to laundered textiles.

The compositions and methods of the present invention are advantageous in providing low cost liquid laundry detergents compositions offering good cleaning along with softening benefits through the wash to textiles such as clothing and fabrics. Additional objects and advantages will be apparent in view of the detailed description of the invention.

Cationic Hydroxyethyl Cellulose Polymers

The aqueous liquid laundry detergent compositions of the present invention contain from about 0.05% to about 0.4%, by weight of the composition, of a cationic hydroxyethyl cellulose polymer. In one embodiment, the composition contains from about 0.1% to about 0.3%, by weight of the composition, alternatively from about 0.15% to about 0.2%, of the cationic hydroxyethyl cellulose polymer.

The cationic hydroxyethyl cellulose polymers useful herein have a degree of substitution of the cationic charge of from about 0.01 (one cationic charge per 100 polymer repeating units) to about 0.20 (two cationic charges per 10 polymer repeating units). Preferably, the cationic hydroxyethyl cellulose polymers useful herein have a degree of substitution of the cationic charge of from about 0.01 to about 0.1, more preferably a degree of substitution of the cationic charge of less than 0.1, in one embodiment from about 0.01 to less than 0.1. The positive charges could be on the backbone of the polymers or the side chains of polymers.

Cationic hydroxyethyl cellulose polymers useful include those which may or may not be hydrophobically-modified and have a molecular weight of from about 200,000 to about 800,000. These cationic materials have repeating substituted anhydroglucose units that correspond to the general Structural Formula I as follows:

STRUCTURAL FORMULA I

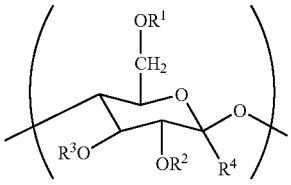

Wherein R1, R2, R3 are each independently H, CH3, C8-24 alkyl (linear or branched),

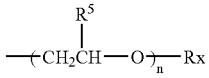

or mixtures thereof; wherein n is from about 1 to about 10; Rx is H, CH3, C8-24 alkyl (linear or branched),

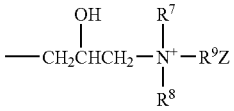

or mixtures thereof, wherein Z is a water soluble anion, preferably a chlorine ion and/or a bromine ion; R5 is H, CH3, CH2CH3, or mixtures thereof; R7 is CH3, CH2CH3, a phenyl group, a C8-24 alkyl group (linear or branched), or mixture thereof; and R8 and R9 are each independently CH3, CH2CH3, phenyl, or mixtures thereof:

R4 is H,

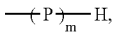

or mixtures thereof wherein P is a repeat unit of an addition polymer formed by radical polymerization of a cationic monomer such as

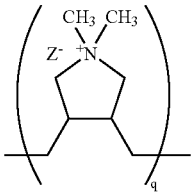

wherein Z' is a water-soluble anion, preferably chlorine ion, bromine ion or mixtures thereof and q is from about 1 to about 10.

Water-soluble anions useful herein include C8-C24 alkyl sulfates, C8-C24 alkyl alkoxy sulfates, preferably alkyl ethoxy sulfates, C8-C24 alkyl sulfonates, C8-C16 alkyl benzene sulfonates, xylene sulfonates, toluene sulfonates, cumene sulfonates, fatty alkyl carboxylates, chlorine ions, bromine ions, or mixtures thereof, while chlorine and/or bromine ions are preferred.

The cationic hydroxyethyl cellulose may have alkyl substitution on the anhydroglucose rings of the polymer ranges. When such alkyl substitution is present, it may be from about 0% to 5% per glucose unit, more preferably from about 0% to 2% per glucose unit, of the polymeric material.

The cationic cellulose may lightly cross-linked with a dialdehyde such as glyoxyl to prevent forming lumps, nodules or other agglomerations when added to water at ambient temperatures.

The cationic hydroxyethyl cellulose ethers of Structural Formula I likewise include those which are commercially available and further include materials which can be prepared by conventional chemical modification of commercially available materials. Commercially available cellulose ethers of the Structural Formula I type useful herein include the LR 400 and LK 400 polymers, preferably the LK 400 polymers, which are marketed by Dow Chemical.

Surfactant

The aqueous liquid laundry detergent products of the present invention comprise from about 5% to about 30%, by weight of the composition, of surfactant. In one embodiment, the aqueous liquid laundry detergent products of the present invention comprise from about 5% to about 20%, alternatively from about 7% to about 15%, by weight of the composition, of surfactant.

The surfactant of the detergent products of the present invention includes at least one anionic surfactant and at least one nonionic surfactant. The detergent products of the present invention may also include other surfactants such as zwitterionic, ampholytic or cationic type or can comprise compatible mixtures of these types in conjunction with the anionic surfactant and nonionic surfactant.

In one embodiment, the anionic surfactant is selected from alkyl ethoxylate sulfates and linear alkyl benzene sulfonates. In another embodiment, the anionic surfactant is selected from alkyl ethoxylate sulfates having a chain length of from about 12 to about 14 and a degree of ethoxylation of from about 1 to about 8.

Detergent surfactants useful herein include those described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980.

Anionic surfactants which are suitable for use herein include the water-soluble salts, preferably the alkali metal, and ammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are a) the sodium, potassium and ammonium alkyl sulfates, especially those obtained by sulfating the higher alcohols ($C_8$-$C_{18}$ carbon atoms) such as those produced by reducing the glycerides of tallow or coconut oil; b) the sodium, potassium and ammonium alkyl polyethoxylate sulfates, particularly those in which the alkyl group contains from 10 to 22, preferably from 12 to 18 carbon atoms, and wherein the polyethoxylate chain contains from 1 to 15, preferably 1 to 6 ethoxylate moieties; and c) the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383. Also useful are linear straight chain alkylbenzene sulfonates in which the average number of carbon atoms in the alkyl group is from about 11 to 13, abbreviated as $C_{11-13}$ LAS.

In one embodiment, nonionic surfactants useful herein include those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. In one embodiment, the nonionic surfactants are condensation products of $C_{12}$-$C_{15}$ alcohols with from about 5 to about 20 moles of ethylene oxide per mole of alcohol, e.g., $C_{12}$-$C_{13}$ alcohol condensed with about 6.5 moles of ethylene oxide per mole of alcohol.

Additional suitable nonionic surfactants include polyhydroxy fatty acid amides of the formula:

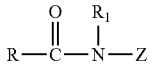

wherein R is a $C_{9-17}$ alkyl or alkenyl, $R_1$ is a methyl group and Z is glycidyl derived from a reduced sugar or alkoxylated derivative thereof. Examples are N-methyl N-1-deoxyglucityl cocoamide and N-methyl N-1-deoxyglucityl oleamide. Processes for making polyhydroxy fatty acid amides are known and can be found in Wilson, U.S. Pat. No. 2,965,576 and Schwartz, U.S. Pat. No. 2,703,798, the disclosures of which are incorporated herein by reference.

Fatty Acid

The aqueous liquid detergent compositions of the present invention contain from about 2% to about 15%, by weight of the composition, of fatty acid. In one embodiment, the compositions contain from about 2% to about 10%, alternatively from about 2.5% to about 7%, by weight of the composition, of fatty acid.

A used herein, "fatty acids" refers to a range of fatty acids including those that contain from about 8 to about 24 carbon atoms, alternatively from about 12 to about 18 carbon atoms. The fatty acids useful herein include those that are both saturated and unsaturated, as well as mixtures thereof.

Free of Optical Brightener

In one embodiment, the aqueous liquid detergent compositions of the present invention are substantially free of optical brightener. As used herein, "substantially free of optical brightener" means that the aqueous liquid detergent composition contains less than 0.0001% of optical brightener, preferably no detectable amount of optical brightener.

Enzymes Having Cellulytic Activity

In one embodiment, the aqueous liquid detergent compositions of the present invention are substantially free of enzymes containing cellulytic activity. The aqueous liquid detergent compositions of the present invention may comprise an enzyme that is free of cellulytic activity. As used herein, "substantially free of enzymes containing cellulytic activity" means that the aqueous liquid detergent composition contains less than 0.001% of an enzyme containing cellulytic activity, preferably no detectable amount of enzyme containing cellulytic activity.

Without being limited by theory, it is believed that the cellulase present in certain enzymes will hydrolyze the cationic hydroxyethyl cellulose polymer molecule, thereby destroying the fabric care benefits otherwise associated with the cationic hydroxyethyl cellulose polymer.

However, where desirable, it is possible to formulate aqueous liquid detergent compositions of the present invention that do contain enzymes having cellulytic activity as long as the composition also contains an effective amount of a cellulase inhibitor.

Enzymes

When incorporated into the formulations of the present invention, enzymes are included at levels sufficient to provide a "cleaning-effective amount". The term "cleaning-effective amount" refers to any amount capable of producing a cleaning, stain removal, soil removal, whitening, deodorizing, or freshness improving effect on substrates such as fabrics. In one embodiment, the aqueous liquid detergent compositions of the present invention may contain up to about 5 mg by weight, more typically from about 0.01 mg to about 3 mg, of active enzyme per gram of the detergent composition. Stated otherwise, the compositions herein will typically comprise from about 0.001% to about 5%, preferably from about 0.01% to about 1% by weight of the composition, of a commercial enzyme preparation. Protease enzymes are preferably present in such commercial preparations at levels sufficient to provide from 0.005 to 0.1 Anson units (AU) of activity per gram of composition. Higher active levels may be desirable in highly concentrated detergent formulations.

Selected proteases which are useful herein include the subtilisins which are obtained from particular strains of *B. subtilis* and *B. licheniformis*. A preferred protease is obtained from a strain of *Bacillus*, having maximum activity throughout the pH range of 8-12, developed and sold as ESPERASE® by Novo Industries A/S of Denmark, hereinafter "Novo". The preparation of this enzyme and analogous enzymes is described in GB 1,243,784 to Novo. Other suitable proteases include ALCALASE® and SAVINASE® from Novo and MAXATASE® from International Bio-Synthetics, Inc., The Netherlands. When desired, a protease having decreased adsorption and increased hydrolysis may be included in the compositions herein, as described in WO 9507791 to Procter & Gamble. Another recombinant trypsin-like protease for detergents suitable herein is described in WO 9425583 to Novo.

Any known amylase may be included in the compositions of the present invention.

Suitable lipase enzymes for use herein include those produced by microorganisms of the *Pseudomonas* group, such as *Pseudomonas stutzeri* ATCC 19.154, as disclosed in GB 1,372,034. See also lipases in Japanese Patent Application 53,20487, laid open Feb. 24, 1978. This lipase is available from Amano Pharmaceutical Co. Ltd., Nagoya, Japan, under the trade name Lipase P "Amano," or "Amano-P." Other suitable commercial lipases include Amano-CES, lipases ex *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., The Netherlands, and lipases ex *Pseudomonas gladioli*. LIPOLASE® enzyme derived from *Humicola lanuginosa* and commercially available from Novo, see also EP 341,947, is a preferred lipase for use herein.

When the compositions of the present invention contain a compatible enzyme, the compositions preferably also contain an effective enzyme stabilizing system. The enzyme-containing aqueous liquid laundry detergent compositions herein may therefore optionally also comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the enzymes useful herein. Such a system may be inherently provided by other formulation actives, or be added separately, e.g., by the formulator or by a manufacturer of enzymes. Such stabilizing systems can, for example, comprise calcium ion, boric acid, propylene glycol, short chain carboxylic acids, boronic acids, or mixtures thereof, and are designed to address different stabilization problems depending on the type and physical form of the detergent composition. Where enzymes having cellulytic activity are included into the aqueous liquid laundry detergent compositions herein, the enzyme stabilizing system should also include the cellulase inhibitor.

Builder

The compositions may also comprise from about 0.1% to 80% by weight of a builder. In one embodiment, the compositions of the present invention contain from about 1% to 20% by weight of the builder component. Detergent builders are well known in the art and can comprise, for example, phosphate salts as well as various organic and inorganic nonphosphorus builders.

Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic acids, and citric acid. Other suitable polycarboxylates for use herein are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al. Polycarboxylate builders useful herein include the oxydisuccinates and the ether carboxylate builder compositions comprising a combination of tartrate monosuccinate and tartrate disuccinate described in U.S. Pat. No. 4,663,071, Bush et al., issued May 5, 1987.

Examples of suitable nonphosphorus, inorganic builders include the silicates, aluminosilicates, borates and carbonates.

Aqueous Liquid Laundry Detergents

The aqueous liquid detergent compositions of the present invention may be made by any known process, including those processes disclosed in U.S. Pat. Nos. 6,274,540 and 6,306,817; WIPO Publication Nos. WO 01/16237 published Mar. 8, 2001; and WO 01/16263 published on Mar. 8, 2001.

The laundry detergent compositions herein are formulated as aqueous liquid laundry detergents. The detergent compositions herein therefore comprise from about 3% to about 98%, alternatively from about 15% to about 95%, by weight of the liquid detergent composition, of an aqueous liquid carrier which is preferably water. Preferably, the liquid laundry compositions according to the present invention should provide a wash solution pH from about 6 to about 10, more preferably from about 7 to about 9, in order to maintain a preferred cleaning and fabric care performance by the aqueous liquid detergents according to the present invention. If needed, the cleaning compositions may contain alkalinizing agents, pH control agents and/or buffering agents.

Laundry Adjunct Ingredients

The laundry detergents herein may further comprise a laundry adjunct ingredient. Suitable laundry adjuncts are known in the art and include soil release polymers, dye transfer inhibiting polymers, chelants, performance boosting polymers, preservatives, stabilizers, structurants, viscosity modifiers, citric acid, and benefit agent containing delivery particles.

Benefit agent containing delivery particles useful herein comprise a core material and a wall material that at least partially surrounds said core material. As used herein, the phrase "benefit agent containing delivery particle" encompasses microcapsules, including perfume microcapsules (where the core material includes perfume). As used herein, the terms "particle", "benefit agent containing delivery particle", "capsule" and "microcapsule" are synonymous.

EXAMPLES 1-4

The following example aqueous liquid detergent formulations may be made by traditional methods and means as known to one of ordinary skill in the art.

| Ingredient | 1 Wt. % | 2 Wt % | 3 Wt % | 4 Wt % |
|---|---|---|---|---|
| Nonionic surfactant | 4.0 | 4.0 | 7.0 | 4.0 |
| Anionic surfactant | 7.0 | 3.0 | 8.0 | 3.0 |
| Citric Acid | 2.0 | 3.0 | 2.5 | 3.0 |
| Fatty acid | 4.5 | 3.0 | 6.0 | 3.0 |
| PVPVI | 0.02 | 0.03 | 0.05 | 0.03 |
| Performance Boosters | 0.3 | | 0.5 | |
| Cationic hydroxyl ethyl cellulose | 0.18 | 0.15 | 0.25 | 0.15 |
| Ethanol | 0.85 | 1.00 | 1.2 | 1.00 |
| Boric acid | 1.2 | 0.85 | 1.00 | 0.85 |
| DB110 A | 0.0025 | 0.0025 | 0.0025 | 0.0025 |
| Sodium hydroxide | 3.0 | 3.0 | 3.5 | 3.0 |
| Perfumes and Dyes | 0.6 | 0.5 | 0.7 | 0.5 |
| Opacifier | 0.100 | 0.040 | | 0.040 |
| Preservative | 0.002 | 0.001 | 0.0018 | 0.001 |
| Perfume Microcapsules | | | | 1.3 |
| Water | Remainder | Remainder | Remainder | Remainder |

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous liquid laundry detergent composition useful for cleaning fabrics wherein the composition comprises:

a) from about 0.05% to about 0.4%, by weight of the composition, of a cationic hydroxyethyl cellulose polymer having a degree of substitution of the cationic charge of from about 0.01 to about 0.20;

b) from about 5% to about 30%, by weight of the composition, of a surfactant comprising at least one anionic surfactant and at least one nonionic surfactant;

c) from about 2% to about 15%, by weight of the composition, of fatty acid; and d) a benefit agent containing delivery particle, wherein the delivery particle is a perfume microcapsule;

wherein the composition comprises less than 0.001%, by weight of the composition, of enzymes having cellulytic activity; and wherein the composition comprises less than 0.0001%, by weight of the composition, of optical brightener.

2. An aqueous liquid laundry detergent composition according to claim 1 wherein the cationic hydroxyethyl cellulose polymer has a degree of substitution of the cationic charge of from about 0.01 to about 0.1.

3. An aqueous liquid laundry detergent composition according to claim 2 wherein the cationic hydroxyethyl cellulose polymer has a degree of substitution of the cationic charge of from about 0.01 to less than 0.1.

4. An aqueous liquid laundry detergent composition according to claim 3 wherein the cationic hydroxyethyl cellulose polymer has a molecular weight of from about 200,000 to about 800,000.

5. An aqueous liquid laundry detergent composition according to claim 1 wherein the composition comprises from about 0.1% to about 0.3%, by weight of the composition, of the cationic hydroxyethyl cellulose polymer.

6. An aqueous liquid laundry detergent composition according to claim 2 wherein the composition comprises from about 0.15% to about 0.2%, by weight of the composition, of the cationic hydroxyethyl cellulose polymer.

7. An aqueous liquid laundry detergent composition according to claim 1 wherein the composition comprises from about 7% to about 15%, by weight of the composition, of the surfactant.

8. An aqueous liquid laundry detergent composition according to claim 1 wherein the composition comprises from about 2.5% to about 7%, by weight of the composition, of the fatty acid.

9. An aqueous liquid laundry detergent composition according to claim 1 wherein the composition further comprises an opacifying agent.

10. An aqueous liquid laundry detergent composition according to claim 1 wherein the anionic surfactant is selected from alkyl ethoxylate sulfates and linear alkyl benzene sulfonates.

11. An aqueous liquid laundry detergent composition according to claim 5 wherein the anionic surfactant is selected from alkyl ethoxylate sulfates having a chain length of from about 12 to about 14 and a degree of ethoxylation of from about 1 to about 8.

12. An aqueous liquid laundry detergent composition according to claim 1 wherein the composition funkier comprises a suds suppressor.

13. An aqueous liquid laundry detergent composition according to claim 1 wherein the composition is substantially free of enzymes.

14. An aqueous liquid laundry detergent composition according to claim 1 wherein the composition further comprises a laundry adjunct ingredient selected from soil release polymers, dye transfer inhibiting polymers, chelants, performance boosting polymers, preservatives, stabilizers, structurants, viscosity modifiers, and citric acid.

15. An aqueous liquid laundry detergent composition according to claim 1 wherein the composition further comprises from about 0.01 to about 1% of a structurant that is selected from hydrogenated castor oil.

16. An aqueous liquid laundry detergent composition useful for cleaning delicate fabrics wherein the composition comprises:

a) from about 0.15% to about 0.2%, by weight of the composition, of a cationic hydroxyethyl cellulose polymer having a molecular weight of from about 200,000 to about 800,000 and a degree of substitution of the cationic charge of from about 0.01 to 0.20;

b) from about 7% to about 15%, by weight of the composition, of a surfactant comprising an alkyl ethoxylate sulfate surfactant and at least one nonionic surfactant;

c) a benefit agent containing delivery particle, wherein the delivery particle is a perfume microcapsule; and d) from about 2% to about 10%, by weight of the composition, of fatty acid;

wherein the composition comprises less than 0.0001%, by weight of the composition, of optical brightener; and wherein the composition comprises less than 0.001%, by weight of the composition, of enzymes having cellulytic activity.

17. An aqueous liquid laundry detergent composition according to claim 16 wherein the composition comprises from about 2.5% to about 7%, by weight of the composition, of the fatty acid.

18. An aqueous liquid laundry detergent composition according to claim 16 wherein the alkyl ethoxylate sulfate surfactant has a chain length of from about 12 to about 14 and a degree of ethoxylation of from about 1 to about 8.

* * * * *